US010092907B2

(12) United States Patent
Mankosa et al.

(10) Patent No.: US 10,092,907 B2
(45) Date of Patent: Oct. 9, 2018

(54) SELF-CLEANING SPLITTER

(71) Applicant: Eriez Manufacturing Co., Erie, PA (US)

(72) Inventors: Michael J. Mankosa, Erie, PA (US); Christopher D. Cedzo, Fairview, PA (US); Gregory Nowak, Fairview, PA (US); Christopher Knoll, Fairview, PA (US); Everett Hull, Lake City, PA (US)

(73) Assignee: ERIEZ MANUFACTURING CO., Erie, PA (US)

( * ) Notice: Subject to any disclaimer, the term of this patent is extended or adjusted under 35 U.S.C. 154(b) by 0 days.

(21) Appl. No.: 15/140,331

(22) Filed: Apr. 27, 2016

(65) Prior Publication Data

US 2016/0310961 A1 Oct. 27, 2016

Related U.S. Application Data

(60) Provisional application No. 62/153,301, filed on Apr. 27, 2015.

(51) Int. Cl.

| | |
|---|---|
| ***B03C 1/035*** | (2006.01) |
| ***B03C 1/16*** | (2006.01) |
| ***B03C 1/031*** | (2006.01) |
| *B03C 1/28* | (2006.01) |

(52) U.S. Cl.

CPC ..... *B03C 1/16* (2013.01); *B03C 1/031* (2013.01); *B03C 1/035* (2013.01); *B03C 1/284* (2013.01)

(58) Field of Classification Search

CPC .. B03C 1/035; B03C 1/10; B03C 1/12; B03C 1/14; B03C 1/247; B03C 1/30; B03C 2201/28; B03C 1/145; B03C 1/16; B03C 1/18; B03C 1/031; B03C 1/26; B03C 1/284

See application file for complete search history.

(56) References Cited

U.S. PATENT DOCUMENTS

| | | | | |
|---|---|---|---|---|
| 3,757,946 | A * | 9/1973 | Berkowitz | B03B 7/00 209/616 |
| 4,192,231 | A * | 3/1980 | Kawakami | B41F 35/04 101/169 |
| 4,265,705 | A * | 5/1981 | Pyykkonen | D21G 3/005 100/174 |
| 4,451,360 | A * | 5/1984 | Salmi | B03C 1/10 209/215 |
| 4,522,582 | A * | 6/1985 | Curtis | F23D 11/386 137/244 |
| 4,880,539 | A * | 11/1989 | Crawford | B01D 29/117 15/256.5 |
| 5,264,904 | A * | 11/1993 | Audi | G03G 21/0029 15/256.5 |

(Continued)

*Primary Examiner* — Joseph C Rodriguez

(74) *Attorney, Agent, or Firm* — Jonathan M. D'Silva; MMI Intellectual Property

(57) ABSTRACT

A splitter that physically delineates the travel path between material steams having different trajectories mounted on a metal sorting system. The splitter has an outer edge and comprising an automatic mechanism located at the outer edge for removing accumulated debris from the splitter. The automatic mechanism may be a sliding body that moves across said outer edge or a retractable blade extends and retracts to remove debris from the splitter.

12 Claims, 8 Drawing Sheets

(56) References Cited

U.S. PATENT DOCUMENTS

| | | | | |
|---|---|---|---|---|
| 7,309,402 | B2 * | 12/2007 | Reid | B41F 35/008 118/413 |
| 7,367,457 | B2 * | 5/2008 | Warlitz | B03C 1/14 209/225 |
| 8,770,413 | B2 * | 7/2014 | Ackley | B07C 5/3422 209/509 |
| 8,931,644 | B2 * | 1/2015 | Lean | B03B 5/32 209/362 |
| 9,221,061 | B2 * | 12/2015 | Rem | B03C 1/247 |
| 2010/0078362 | A1 * | 4/2010 | Riise | B03C 1/01 209/3.3 |
| 2010/0088900 | A1 * | 4/2010 | Davis | B26B 5/003 30/162 |
| 2014/0238906 | A1 * | 8/2014 | Mohanty | B03B 5/626 209/571 |
| 2015/0298138 | A1 * | 10/2015 | Vareika | B03C 1/14 210/222 |

* cited by examiner

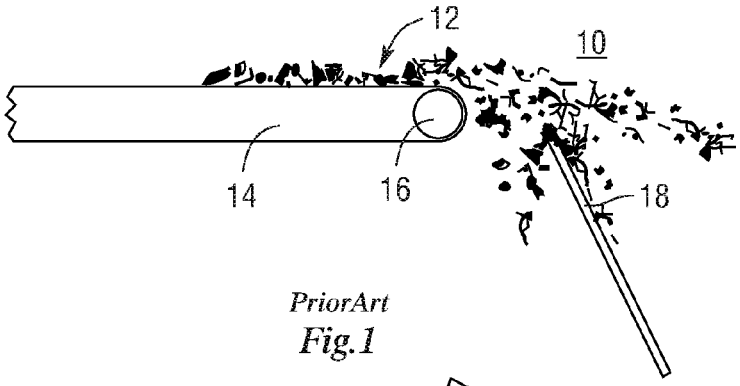
PriorArt
*Fig.1*

SELF-CLEANING SPLITTER

This application takes priority from U.S. Provisional Patent Application No. 62/153,301, incorporated herein by reference.

BACKGROUND

Metal sorting systems are used to separate materials that have a mixture of magnetic ferrous materials from non-magnetic waste materials. Other sorting systems sort non-ferrous metals from nonmetallic waste. In either case, the streams of material to be sorted are placed on conveyor belts and are exposed to magnetic fields that affect different kinds of material in the material streams different such that as the material stream is expelled from the end of the conveyor belt, the expulsion trajectory of different material types is different based on how they interact with the magnetic field at the end of the conveyor belt. It has been found that in any type of sorting system described above, that incorporating a splitter to physically delineate the travel path between the magnetic ferrous materials and the non-magnetic material significantly improves the quality of the separation. However, debris tends to accumulate on the splitters which obstructs the flow of materials on either side of the splitter. The typical solution to this is that the splitters have to be periodically cleaned of debris which often times requires a shutdown of the processing equipment and is labor intensive. What is presented are several embodiments of self-cleaning splitters that operate while the equipment is in use and requires little labor to operate.

SUMMARY

All embodiments of splitters disclosed, physically delineate the travel path between material steams having different trajectories on a metal sorting system. The splitters have an outer edge and comprises an automatic mechanism located at the outer edge for removing accumulated debris from the splitter. The automatic mechanism may be actuated at set time intervals, by remote signal from an operator, or by an operator at the splitter itself. In some embodiments, the automatic mechanism is actuated by a signal caused by debris accumulation on the splitter disrupting the path of a light source to an optical sensor.

In some embodiments, the automatic mechanism is a rotating tip that revolves to dislodge accumulated debris. In some embodiments, the rotating tip has a diamond shape and in others the rotating tip has a triangular shape.

In some embodiments, the automatic mechanism is a retractable blade embedded within the splitter. Removal of accumulated debris from the splitter is achieved by extending and then retracting the retractable blade from the splitter or by retracting and then extending the retractable blade from the splitter.

In other embodiments, the automatic mechanism is a sliding body that moves across the outer edge of the splitter. The sliding body may be pneumatically activated or electrically driven. In some embodiments, the sliding body is mounted to a ball screw.

Those skilled in the art will realize that this invention is capable of embodiments that are different from those shown and that details of the apparatus and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

FIG. 1 shows a stylized view of a metal sorting system with a prior art splitter;

DETAILED DESCRIPTION

Figure 2:
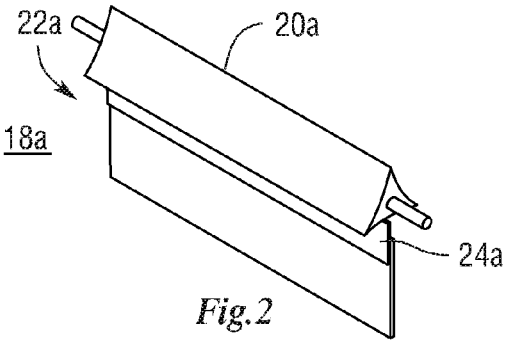
FIG. 2 shows an embodiment of splitter having an automatic mechanism for removing debris from the splitter that is a rotating tip in a triangular shape.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

FIG. 1 shows a metal sorting system 10 are used to separate materials 12 that have a mixture of magnetic ferrous materials from non-magnetic waste materials. Other sorting systems sort nonferrous metals from nonmetallic waste. In either case, the stream of material 12 to be sorted are placed on a conveyor belt 14 and are exposed to magnetic fields that are generated using magnets 16 located at the end of the conveyor belt 14. The magnets 16 in different metal sorting systems 10 may permanent magnets or electro magnets, may be rotating or stationary, and may be arranged in a variety of ways in a variety of combinations that generate magnetic fields that affect different kinds of material in the material stream 12 in slightly different ways depending on the application. In any case, the conveyor belt 14 imparts forward momentum on the material 12 as it is expelled from the end of the conveyor belt 14. The expulsion trajectory of different material 12 types is different based on how they interact with the magnetic field at the end of the conveyor belt. Differently magnetic materials will have their exit trajectory influenced by the type and combination of magnets 16 in the metal sorting system 10. This allows mixtures of material 12 to be sorted based on how the material components interact with the magnetic fields. It has been found that in any type of sorting system 10 described above, that incorporating a splitter 18 to physically delineate the travel path between the differently affected materials significantly improves the quality of the separation. However, debris tends to accumulate on the outer edge of the splitter 18. This obstructs the flow of materials 12 on either side of the splitter 18. The typical solution to this is that the splitters have to be periodically cleaned of debris which often times requires a shutdown of the processing equipment and is labor intensive. What is presented are several embodiments of self-cleaning splitters that operate while the equipment is in use and requires little labor to operate.

FIG. 2 shows one embodiment of a self-cleaning splitter 18*a*. In this embodiment, the splitter 18*a* comprises an automatic mechanism 20*a* located on the outer edge of the splitter body 22*a*. In this embodiment, the automatic mechanism 20*a* is a rotatable head mounted to a motor (not shown). In this embodiment, the rotatable head of the automatic mechanism 20*a* has a triangular shape. A divider 24*a* is interposed between the automatic mechanism 20*a* and the splitter body 22*a* to eliminate any gap between them. When the splitter 18*a* is installed on a separating system, separated material flows on either side of the splitter 18*a* and, on occasion, some material will collect on the splitter 18*a*. In order to remove this material, the motor is actuated to rotatable head of the automatic mechanism 20*a* and drop the accumulated material from the splitter 18*a*. Removal of material may be accomplished by activating the automatic mechanism 20*a* periodically at some set time interval or as needed by an operator, either by a remote signal or direct actuation.

Figure 3:
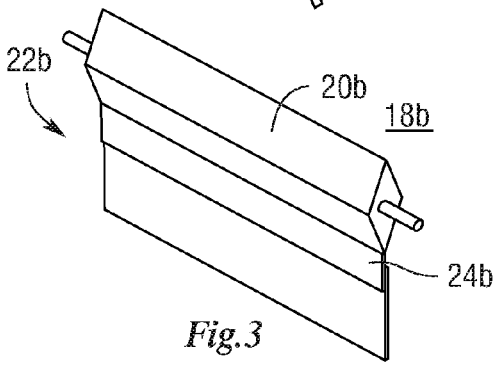
FIG. 3 shows an embodiment of splitter having an automatic mechanism for removing debris from the splitter that is a rotating tip in a diamond shape.

FIG. 3 shows another embodiment of a self-cleaning splitter 18*b*. Similar to the embodiment in FIG. 2, the splitter 18*b* comprises an automatic mechanism 20*b* located on the outer edge of the splitter body 22*b*. In this embodiment, the automatic mechanism 20*b* is a rotatable head in a diamond shape mounted to a motor (not shown). A divider 24*b* is interposed between the automatic mechanism 20*b* and the splitter body 22*b* to eliminate any gap between them. The operation of this embodiment is identical to the embodiment shown in FIG. 2.

Figure 4:
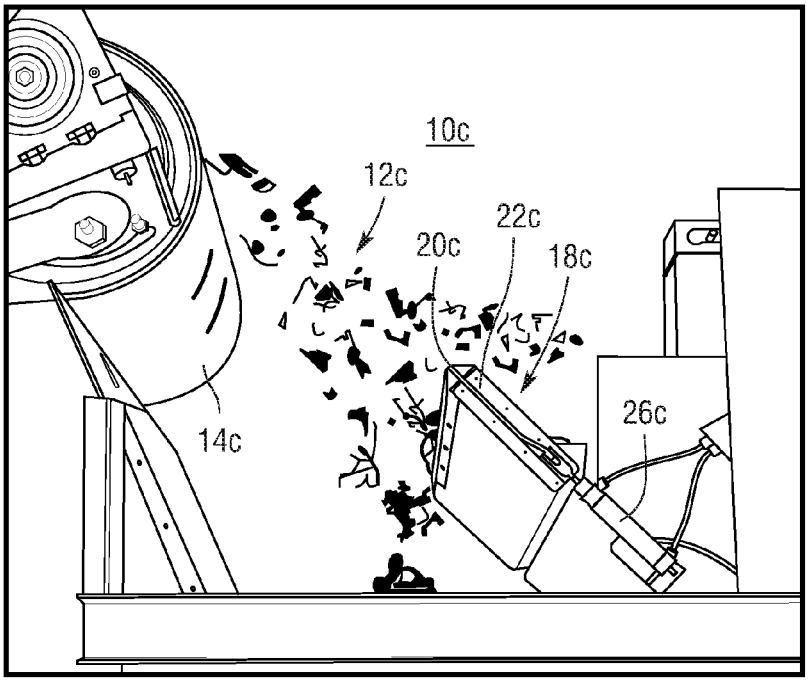
FIG. 4 shows an embodiment of a splitter having an automatic mechanism for removing debris from the splitter that is a blade embedded within the splitter body.
Figure 5:
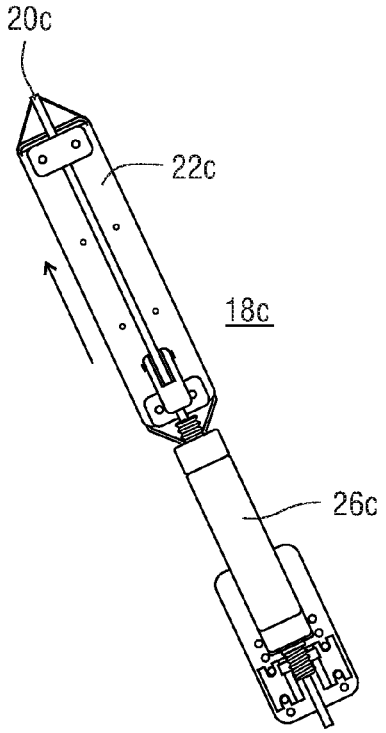
FIG. 5 is a side profile view of the splitter of FIG. 4 with the blade in the retracted position.
Figure 6:
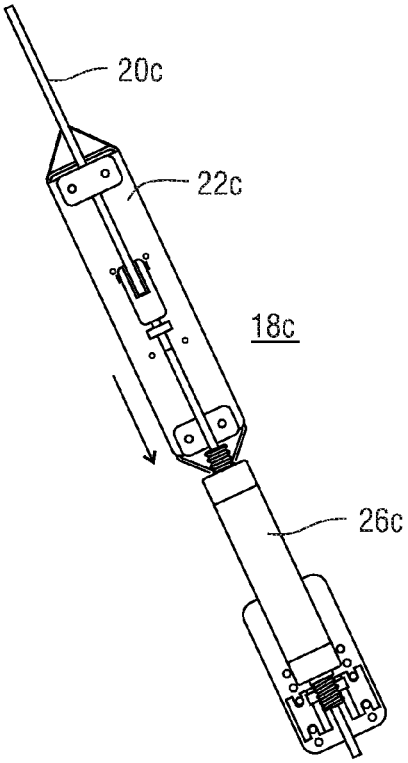
FIG. 6 is a side profile view of the splitter of FIG. 4 with the blade in the extended position.
Figure 7:
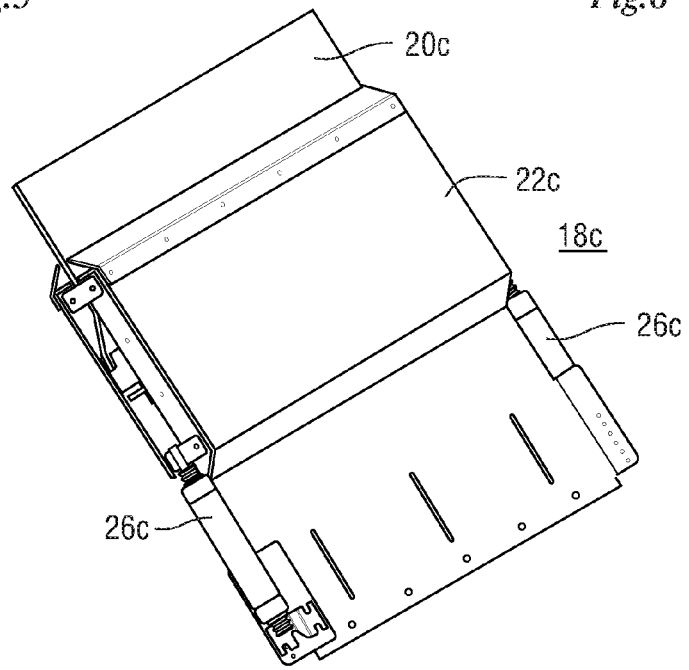
FIG. 7 is a perspective view of the splitter of FIG. 4 with the blade in the extended position.
Figure 8:
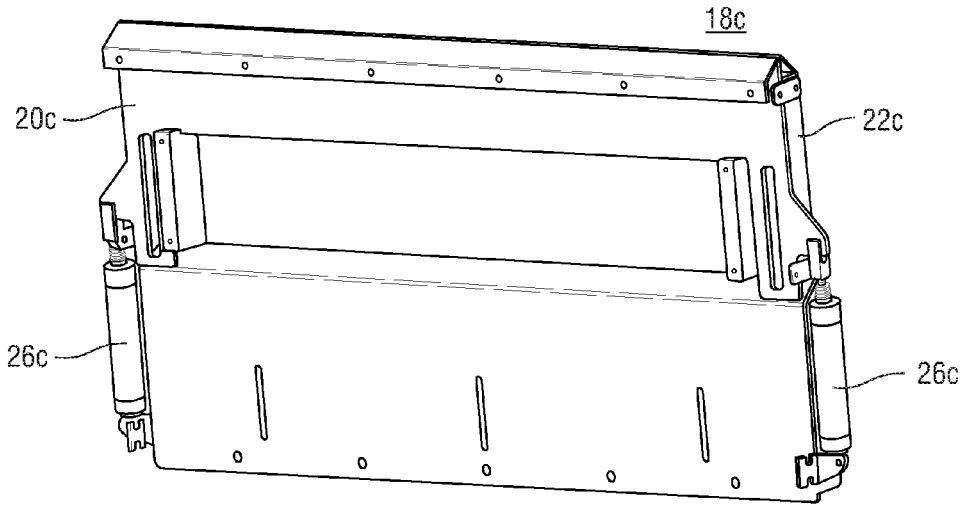
FIG. 8 is a perspective view of the splitter of FIG. 4 with the blade in the retracted position with one side of the splitter body removed showing the positioning of the blade within the splitter body.
Figure 9:
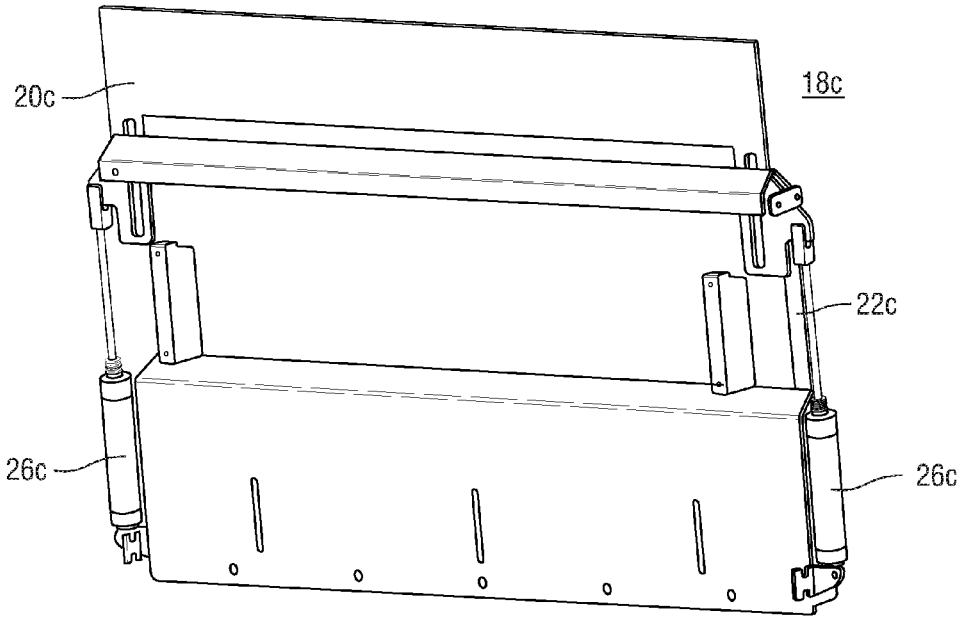
FIG. 9 is a perspective view of the splitter of FIG. 4 with the blade in the extended position with one side of the splitter body removed showing the positioning of the blade within the splitter body.

FIG. 4 shows another embodiment of self-cleaning splitter 18*c* installed in a metal sorting system 10*c*. As with the prior art systems discussed earlier, the splitter 18*c* physically delineates the travel path between the differently affected materials 12*c* significantly improves the quality of the separation. As with prior art systems, some material 12*c* will accumulate on the outer edge of the splitter body 22*c*. In this embodiment, the automatic mechanism 20*c* is the blade embedded within the splitter body 22*c*. As best understood by reviewing FIGS. 5-9, the blade of the automatic mechanism 20*c* is mounted to a set of pistons 26*c* that are able to move the blade into and out of the splitter body 22*c*. This movement dislodges any accumulated material from the splitter 18*c*.

This embodiment of self-cleaning splitter 18*c* works in one of two ways. In the normal operation, the blade of the automatic mechanism 20*c* is either primarily in the extended position with accumulated material dislodged by retracting the blade in to the splitter body 22*c* or primarily in the retracted position with accumulated material dislodged by extending the blade out of the splitter body 22*c*. Removal of material may be accomplished by activating the automatic mechanism 20*c* periodically at some set time interval or as needed by an operator, either by a remote signal or direct actuation.

Figure 10:
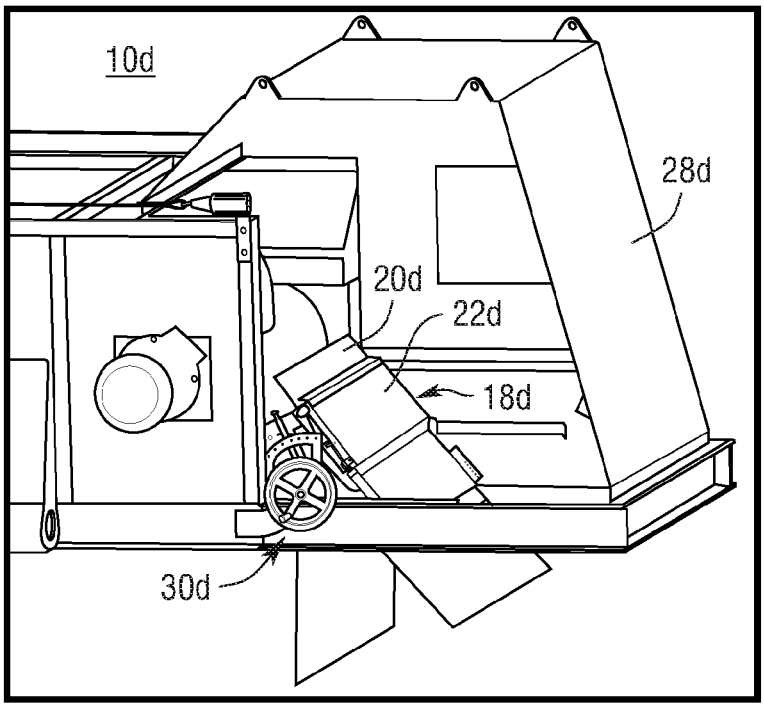
FIG. 10 is a perspective view of another embodiment of splitter shown in FIG. 4 within an enclosure and with adjustment mechanisms.

FIG. 10 shows an embodiment of self-cleaning splitter 18*d* similar to the embodiment of FIG. 4. This embodiment is housed within an enclosure 28*d* that protects the equipment from the elements. In FIG. 10, part of the enclosure 28*d* is removed to show the equipment within. Adjustments to angle and location of the splitter 18*d* can the made with the adjustment mechanisms 30*d* shown.

Figure 11:
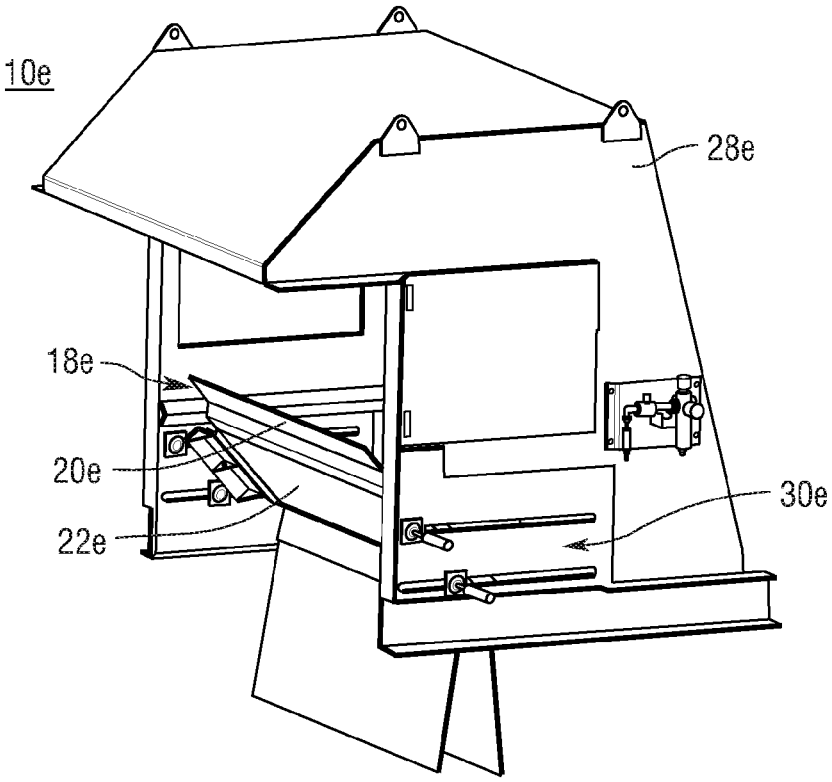
FIG. 11 is a perspective view of another embodiment of splitter shown in FIG. 4 within an enclosure and with different adjustment mechanisms.

FIG. 11 shows another embodiment of self-cleaning splitter 18*e* similar to the embodiment of FIG. 4. This embodiment is housed within an enclosure 28*e* that protects the equipment from the elements. Adjustments to angle and location of the splitter 18*e* can the made with the adjustment mechanisms 30*e* shown.

Figure 12:
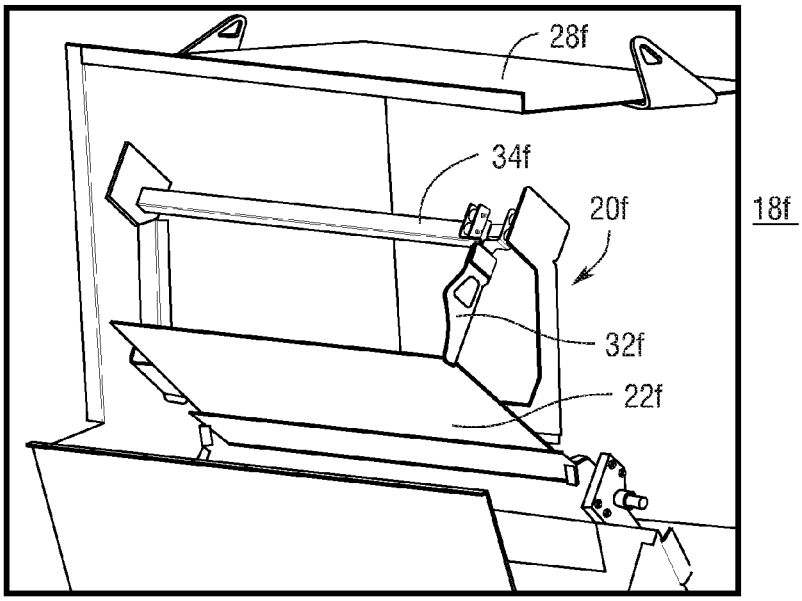
FIG. 12 shows an embodiment of a splitter having an automatic mechanism for removing debris from the splitter that is a sliding body that moves across the outer edge of the splitter body.
Figure 13:
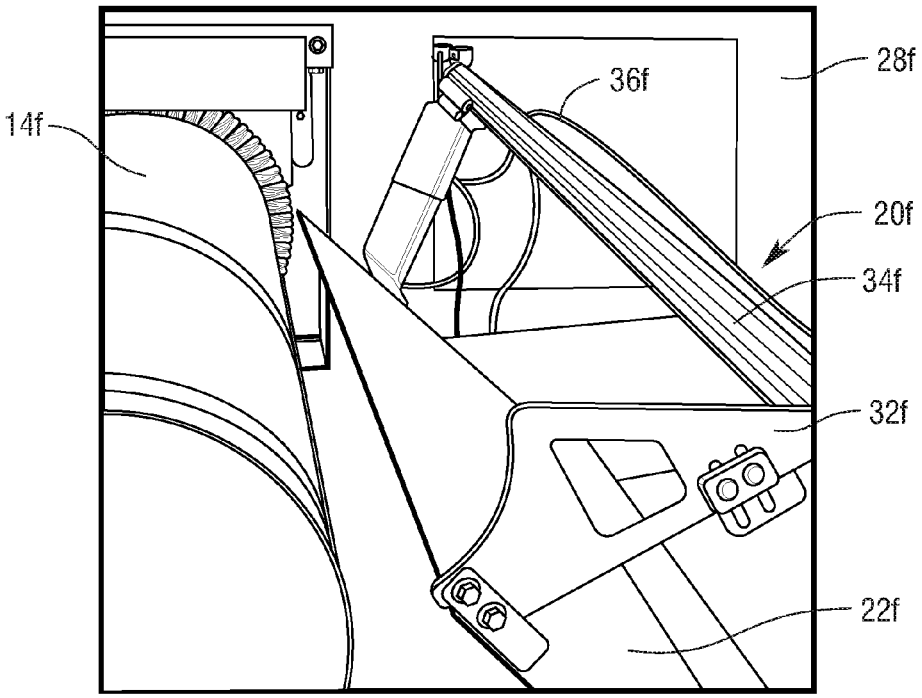
FIG. 13 shows a pneumatically driven embodiment of the splitter of FIG. 12 installed on a metal sorting system.
Figure 14:
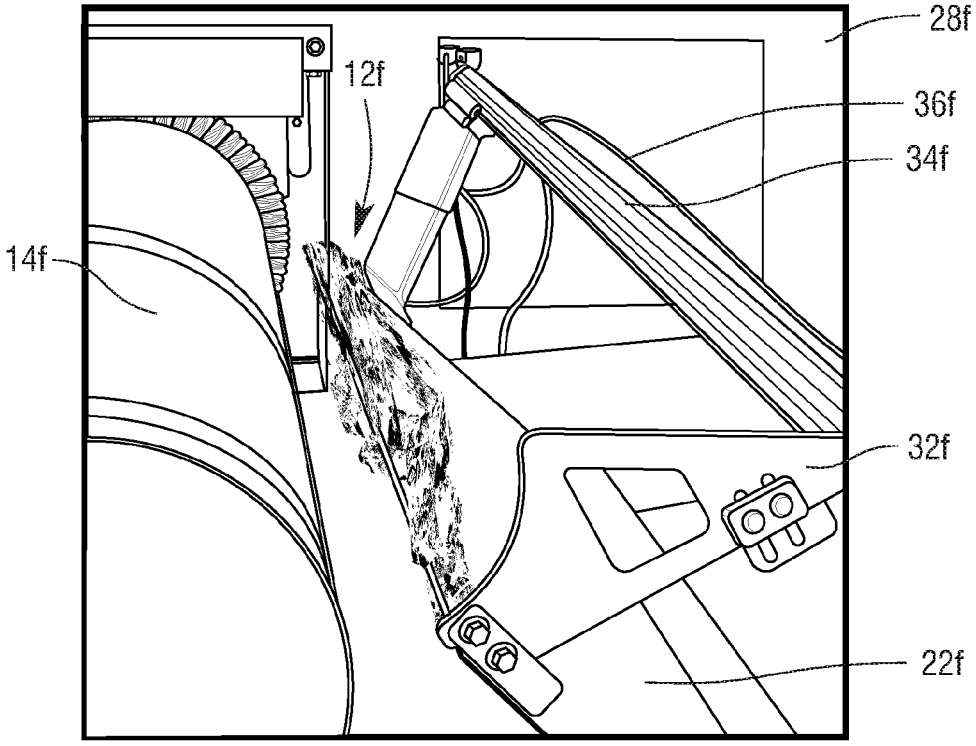
FIG. 14 shows the splitter of FIG. 13 with debris accumulated on the outer edge of the splitter body.
Figure 15:
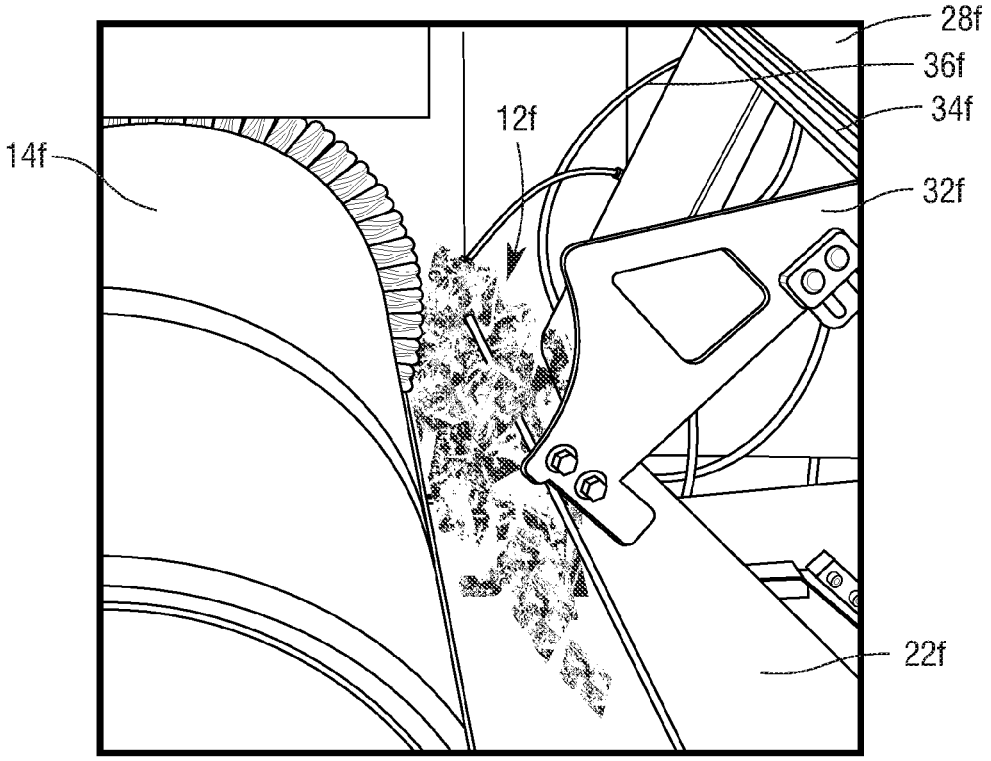
FIG. 15 shows the splitter of FIG. 13 with the automatic mechanism activated and sliding across the outer edge of the splitter body.
Figure 16:
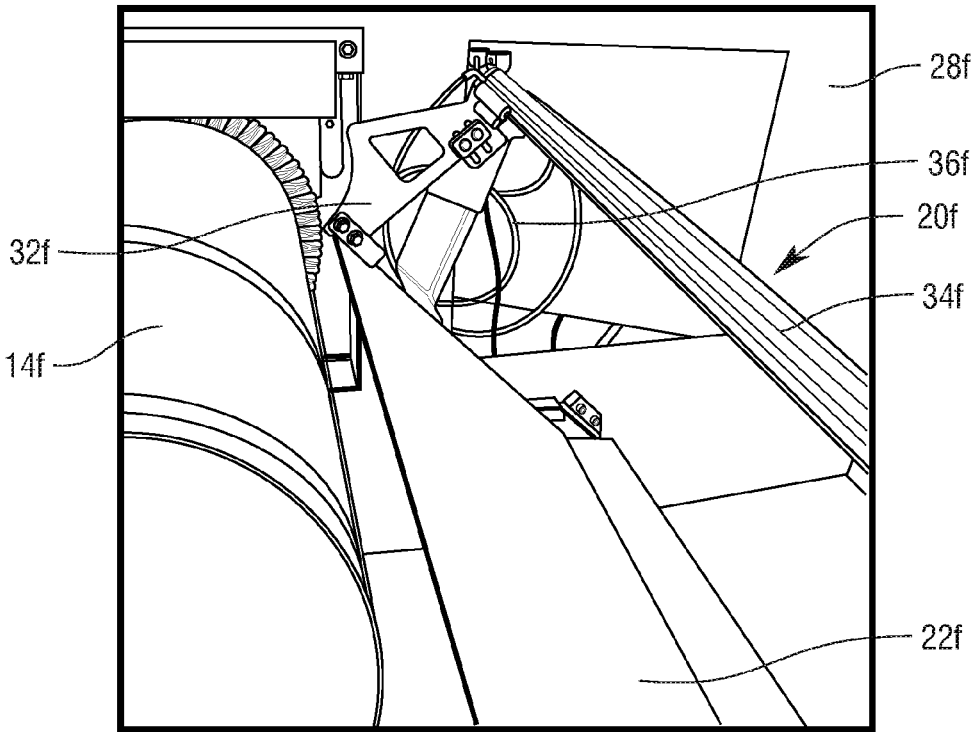
FIG. 16 shows the splitter body of FIG. 13 with the automatic mechanism fully across the outer edge of the splitter body.

FIG. 12 shows another embodiment of self-cleaning splitter 18*f* in which debris accumulated on the outer edge of the splitter 18*f* is removed with an automatic mechanism 20*f* that is a sliding body that moves across the outer edge. In this embodiment, the sliding body is a wiper 32*f* that is mounted to a rail 34*f*. FIGS. 13-16, show the splitter 18*f* in operation on a metal sorting system 14*f*. As material 12*f* accumulates on the outer edge of the splitter body 22*f*, the automatic mechanism 20*f* is actuated periodically at some set time interval or as needed by an operator, either by a remote signal or direct actuation. When triggered, the wiper 32*f* is drawn along the outer edge of the splitter body 22*f* to push accumulated debris 12*f* off of the splitter 18*f*. In these figures, it is apparent from the pneumatic lines 36*f* that the automatic mechanism 20*f* in this embodiment is pneumatically driven.

Figure 17:
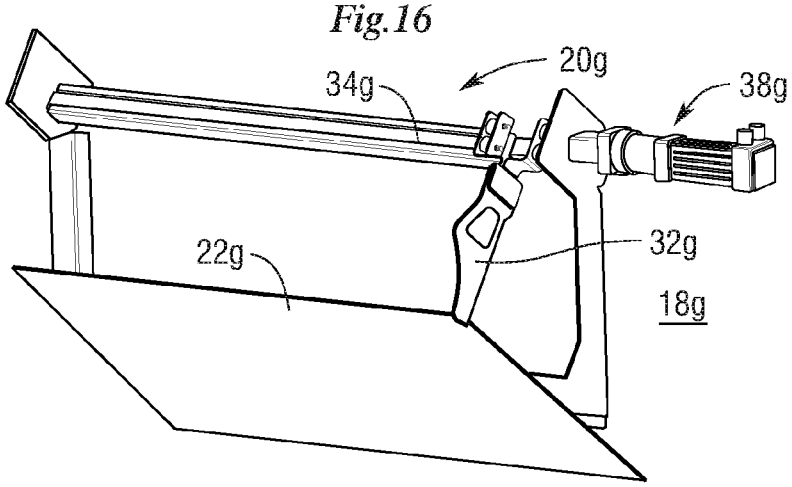
FIG. 17 shows an embodiment of the splitter of FIG. 12 that is electrically driven.

FIG. 17 shown an embodiment of self-cleaning splitter 18*g* that's similar to the embodiments shown and described in FIGS. 12-16. In this embodiment, the automatic mechanism 20*g* is driven by an electrical motor 38*g* that propels the wiper 32*g* along the rail 34*g* and across the outer edge of the splitter body 22*g*.

Figure 18:
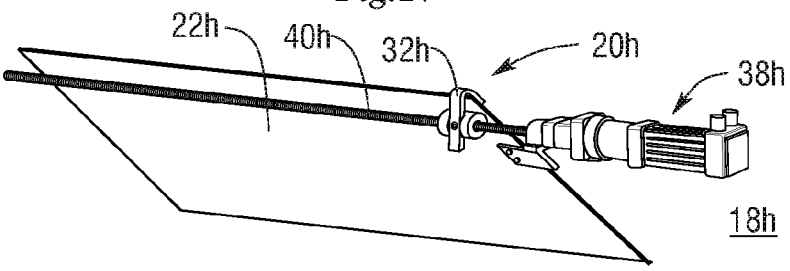
FIG. 18 shows an embodiment of splitter in which the automatic mechanism is mounted to a ball screw.
Figure 19:
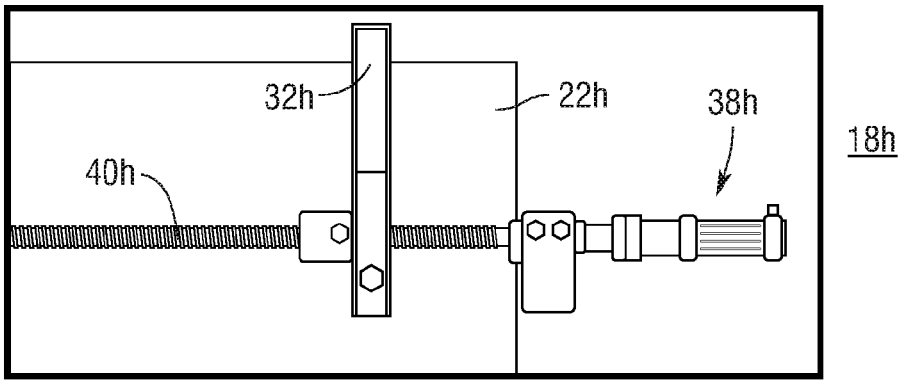
FIG. 19 is a close up of the splitter of FIG. 18.

FIGS. 18 and 19 show another embodiment of self-cleaning splitter 18*h* that incorporates an automatic mechanism 20*h* that is mounted directly to the underside of the splitter body 22*h*. In this embodiment, the wiper 32*h* is mounted to a ball screw mechanism 40*h* that is powered by an electrical motor 38*h*. This embodiment works identically to the embodiments shown and described in FIGS. 12-16. When then automatic mechanism 20*h* is activated, the ball screw mechanism 20*h* moves the wiper 32*h* across the outer edge of splitter body 22*h* to remove accumulated debris from the splitter 18*h*.

Figure 20:
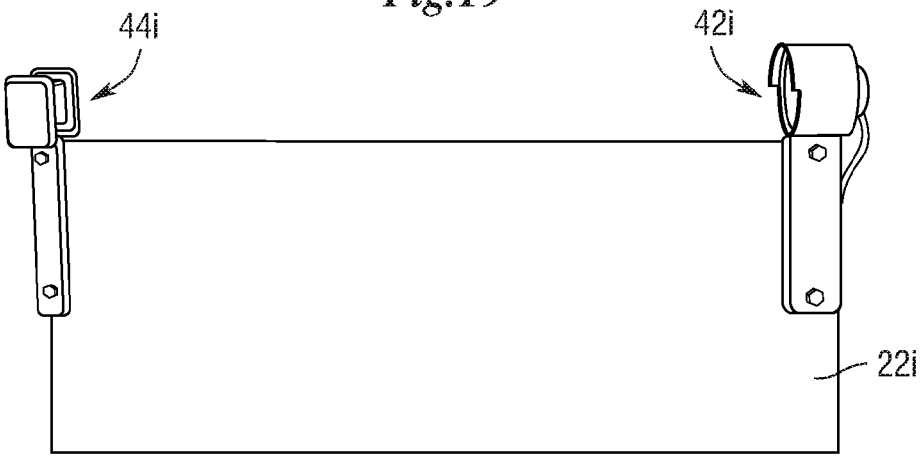
FIG. 20 shows a splitter with a light source and sensor mounted to a splitter body for activating any of the automatic mechanisms described herein.
Figure 21:
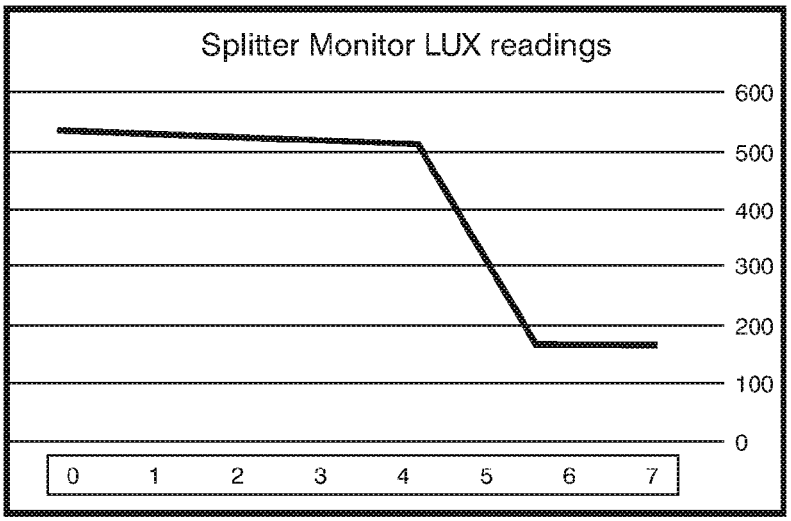
FIG. 21 shows a graph of a light source and sensor reading using the setup shown in FIG. 20.

FIG. 20 shows one means by which any of the self-cleaning splitters described herein may be activated. A light source 42*i* and sensor 44*i* are mounted on the outer edge of the splitter body 22*i*. The graph in FIG. 21 shows that as debris accumulates on the splitter, it begins to the block light from the source 42*i* from reaching the sensor 44*i*. As more debris accumulates, the greater the reduction in the amount of light read by the sensor 44*i*. When the reading reaches a pre-set amount, the automatic mechanism is triggered and the debris is removed from the splitter body.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. A splitter arranged to physically delineate the travel path between material steams having different trajectories comprising:

the splitter having an outer edge;

an automatic mechanism located at said outer edge for removing accumulated debris from the splitter;

said automatic mechanism is a retractable blade; and said automatic mechanism is actuated by at least a signal caused by debris accumulation on the splitter disrupting the path of a light source to an optical sensor.

2. The splitter of claim 1 in which said automatic mechanism is also actuated at set time intervals.

3. The splitter of claim 1 in which said automatic mechanism is also actuated by remote signal from an operator.

4. The splitter of claim 1 in which said retractable blade is embedded within the splitter.

5. The splitter of claim 1 in which removal of accumulated debris from the splitter is achieved by extending and then retracting said retractable blade from the splitter.

6. The splitter of claim 1 in which removal of accumulated debris from the splitter is achieved by retracting and then extending said retractable blade from the splitter.

7. A splitter arranged to physically delineate the travel path between material steams having different trajectories comprising:

the splitter having an outer edge;

an automatic mechanism located at said outer edge for removing accumulated debris from the splitter;

said automatic mechanism is a sliding body that moves across said outer edge; and said automatic mechanism is actuated by at least a signal caused by debris accumulation on the splitter disrupting the path of a light source to an optical sensor.

8. The splitter of claim 7 in which said automatic mechanism is also actuated at set time intervals.

9. The splitter of claim 7 in which said automatic mechanism is also actuated by remote signal from an operator.

10. The splitter of claim 7 in which said sliding body is pneumatically activated.

11. The splitter of claim 7 in which said sliding body is electrically driven.

12. The splitter of claim 7 in which said sliding body is mounted to a ball screw.

* * * * *